US008273197B2

(12) United States Patent
Röstlund

(10) Patent No.: US 8,273,197 B2
(45) Date of Patent: Sep. 25, 2012

(54) PYROTECHNIC PRIMING CHARGE COMPRISING A POROUS MATERIAL

(75) Inventor: Stefan Röstlund, Orebro (SE)

(73) Assignee: Bae Systems Bofors AB, Karlskoga (SE)

( * ) Notice: Subject to any disclaimer, the term of this patent is extended or adjusted under 35 U.S.C. 154(b) by 126 days.

(21) Appl. No.: 12/664,464

(22) PCT Filed: May 30, 2008

(86) PCT No.: PCT/SE2008/000370

§ 371 (c)(1),
(2), (4) Date: May 12, 2010

(87) PCT Pub. No.: WO2008/153465

PCT Pub. Date: Dec. 18, 2008

(65) Prior Publication Data

US 2010/0212788 A1 Aug. 26, 2010

(30) Foreign Application Priority Data

Jun. 14, 2007 (SE) ..... 0701450

(51) Int. Cl.

| | |
|---|---|
| ***C06B 45/00*** | (2006.01) |
| ***C06B 45/18*** | (2006.01) |
| ***D03D 23/00*** | (2006.01) |
| ***D03D 43/00*** | (2006.01) |

(52) U.S. Cl. ..... 149/23; 149/2; 149/3; 149/108.8; 149/109.4

(58) Field of Classification Search ..... 149/23, 149/2, 3, 108.8, 109.4
See application file for complete search history.

(56) References Cited

U.S. PATENT DOCUMENTS

| | | | | |
|---|---|---|---|---|
| 3,171,716 | A | 3/1965 | Diekmann et al. | |
| 3,368,929 | A | 2/1968 | Bell | |
| 5,120,375 | A * | 6/1992 | Mullay et al. | 149/7 |
| 5,540,793 | A * | 7/1996 | Bals et al. | 149/2 |
| 6,984,274 | B2 * | 1/2006 | Hofmann et al. | 149/2 |
| 7,459,043 | B2 * | 12/2008 | Blau et al. | 149/109.4 |
| 2005/0241294 | A1 * | 11/2005 | Cesaroni | 60/251 |
| 2009/0101251 | A1 * | 4/2009 | Subramanian et al. | 149/20 |
| 2010/0051148 | A1 * | 3/2010 | Becker et al. | 149/1 |
| 2011/0011294 | A1 * | 1/2011 | Runemard et al. | 102/335 |

FOREIGN PATENT DOCUMENTS

GB 1025637 A 3/1965

* cited by examiner

*Primary Examiner* — James McDonough
(74) *Attorney, Agent, or Firm* — Connolly Bove Lodge & Hutz LLP

(57) ABSTRACT

Pyrotechnic priming charge (1) intended to be used preferably for starting up one or more ignition chains, comprising a coherent porous fuel structure (2) and at least one oxidizer (4). According to the invention, the primer also comprises a moisture inhibitor (5) applied to the surface of the primer with a view to increasing the safety of the primer and reducing the risk of unintentional ignition due to breakdown of the oxidizer under the influence of ambient moisture and temperature.

6 Claims, 2 Drawing Sheets

PYROTECHNIC PRIMING CHARGE COMPRISING A POROUS MATERIAL

CROSS REFERENCE TO RELATED APPLICATIONS

Figure 1:
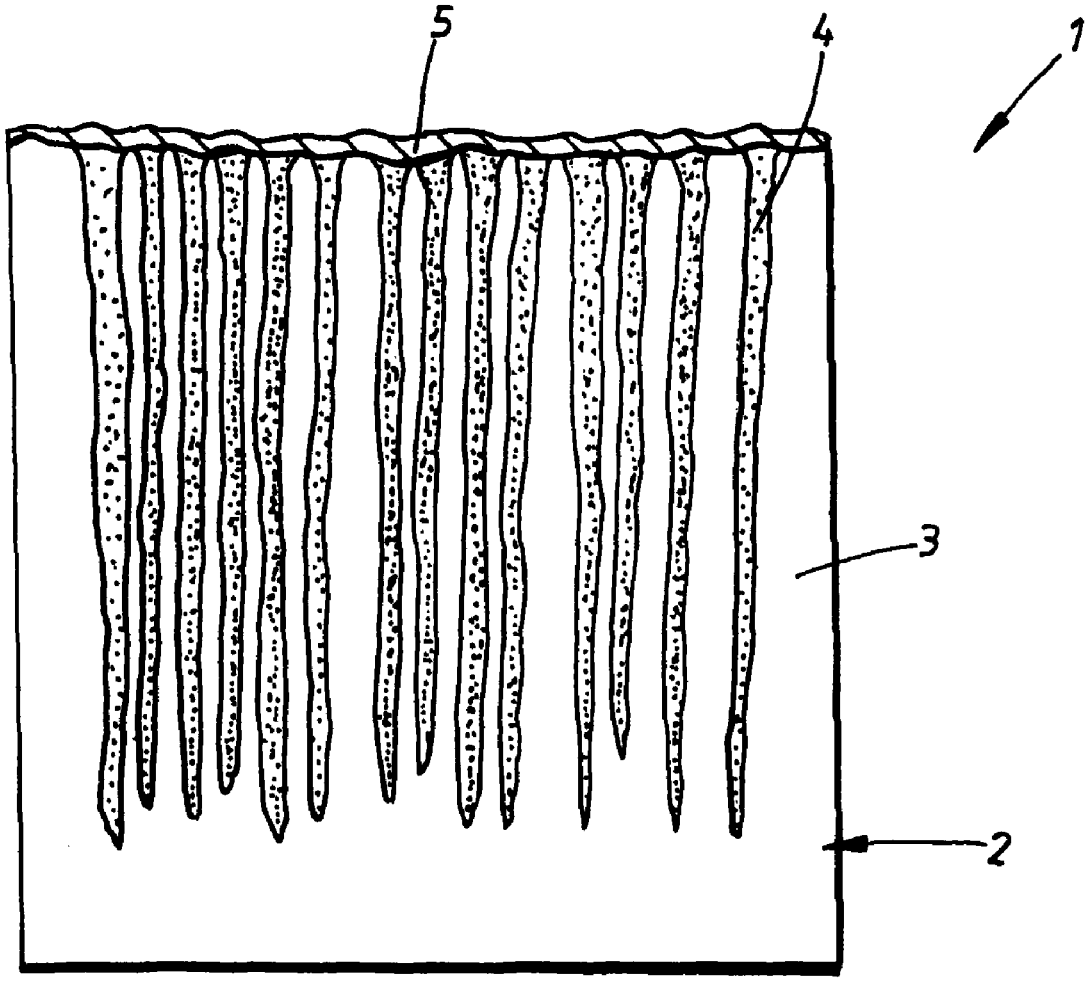

This application is a National Stage Application (under 35 U.S.C. §371) of PCT/SE2008/000370, filed May 30, 2008, which claims benefit of Swedish Application No. 0701450-9, filed Jun. 14, 2007. The entire contents of each of the above-applications are incorporated herein by reference.

TECHNICAL FIELD

The present invention relates to a pyrotechnic priming charge, preferably intended for starting up one or more ignition chains, comprising a coherent porous fuel structure and at least one oxidizer.

BACKGROUND

At present many types of pyrotechnic priming charges are found, hereinafter also referred to as primer, for use either in the civil or the military sector. Civil applications can be within the sphere of vehicle safety, for example gas generators for airbags or safety belt stretchers. Military applications can be shells in which the pyrotechnic priming charge constitutes part of an ignition chain, for example in a detonating cap for detonating an initiator, such as lead azide, which in turn sets off an explosive, for example RDX (Hexogen) or HMX (Octogen).

A pyrotechnic priming charge comprises a mixture of at least one reducing agent, hereinafter also referred to as fuel, and at least one oxidizing agent, hereinafter referred to as oxidizer, as well as further additives such as bonding agents and burning rate moderators. The mixture is normally found in powder form, grain form or granulate form and is worked into a solid body in some type of pressing operation, for example ram pressing, extrusion or isostatic pressing. Once the pyrotechnic priming charge has been initiated and the combustion is underway, oxygen for the combustion is taken from the oxidizer.

One problem with pyrotechnic priming charges of the said type is a low oxygen availability. Low oxygen availability means low efficiency in the combustion. The availability of the oxygen depends essentially on the compactness of the oxidizer and the fuel. Small grains of regular form allow a high compactness and thus a short distance between oxygen and fuel. Large grains of irregular form, on the other hand, mean a low compactness between the grains and thus a large distance between oxygen and fuel. In practice, it is difficult, though, to achieve sufficiently small and regular grains. The ideal case is when the oxygen and the fuel form part of the same molecule, for example in molecules such as nitrocellulose, nitroglycerin and hexogen.

It is known to increase the availability of the oxygen in a pyrotechnic priming charge by dissolving the oxidizer in a solvent and subsequently adding the oxidizer solution to a coherent porous fuel structure, see, for example, document US 2003/0148569 A1.

By distilling off the solvent, the oxidizer will be deposited as a fine crystalline layer in the porous fuel structure.

A coherent porous fuel structure can be likened to a sponge in which parameters such as pore size, pore volume and specific surface area can be controlled by varying the production method. An important advantage with porous fuel structures of this type is the large specific surface area. Large specific surface area means that the distance between the oxygen and the fuel can be made short and mixing can occur at virtually molecular level. Porous fuel structures have long been commercially available and can be produced according to various methods, for example by etching. The basic material in the structure, that is to say the fuel, can be constituted, for example, by silicon, but materials such as carbon, aluminium, magnesium and zinc are also used.

In US 2003/0148569 A1, a pyrotechnic priming charge is described, comprising a coherent porous fuel structure filled with oxidizer. The coherent porous fuel structure consists of silicon, and the oxidizer of lithium nitrate or ammonium perchlorate. The primer is produced by a saturated methanol solution of lithium nitrate being fed to the coherent porous silicon structure, after which the solvent is distilled off, whereupon the oxidizer is precipitated as crystals in the porous silicon structure. It is also known from the literature to use other types of oxidizers, for example organic nitro compounds.

Oxidizers of the said types, especially lithium nitrate and ammonium perchlorate, are moisture and temperature sensitive, which means that, after a period of exposure to the ambient atmosphere, they will be broken down. The breakdown of the oxidizer can lead to unintentional ignition of the pyrotechnic priming charge, which can have serious consequences. Furthermore, the use of chlorine-based oxidizers then means that hydrochloric acid is formed in the combustion, which is damaging to human health and the environment.

The technical problem on which the present invention is founded has been the moisture and temperature sensitivity of oxidizers in pyrotechnic priming charges comprising a coherent porous fuel structure, which moisture and temperature sensitivity can lead to breakdown of the oxidizer and unintentional ignition.

SUMMARY OF THE INVENTION

A primary object of the invention is to provide an improved pyrotechnic priming charge comprising a coherent porous fuel structure and at least one oxidizer, which primer has been made safer by the risk of unintentional ignition due to ambient moisture and temperature having been reduced.

The said object, and other objectives which are not enumerated here, are satisfactorily met within the framework of the content of the present independent patent claims.

A number of advantageous embodiments of the invention are defined in the non-independent patent claims.

According to the present invention, an improved pyrotechnic priming charge has been produced, preferably intended for starting up one or more ignition chains, comprising a coherent porous fuel structure and at least one oxidizer, which pyrotechnic priming charge is characterized in that it also comprises a moisture inhibitor. The object is therefore achieved that the pyrotechnic priming charge has been made safer by preventing breakdown of the oxidizer due to influence from ambient moisture and temperature.

According to further aspects of the pyrotechnic priming charge according to the invention:

- the moisture inhibitor comprises an elastomer, which elastomer is fed to the pyrotechnic priming charge as a prepolymer, which prepolymer, after hardening, has formed a thin elastic film with moisture-repelling properties,
- the elastomer comprises polyisobutane, the oxidizer has low sensitivity to moisture and temperature variations, and the oxidizer therefore comprises a dinitramide salt, the dinitramide salt comprises tetraamine copper dinitramide, the dinitramide salt comprises ammonium dinitramide, the pyrotechnic priming charge also comprises a bonding agent comprising polyglycidyl nitrate.

Figure 2:
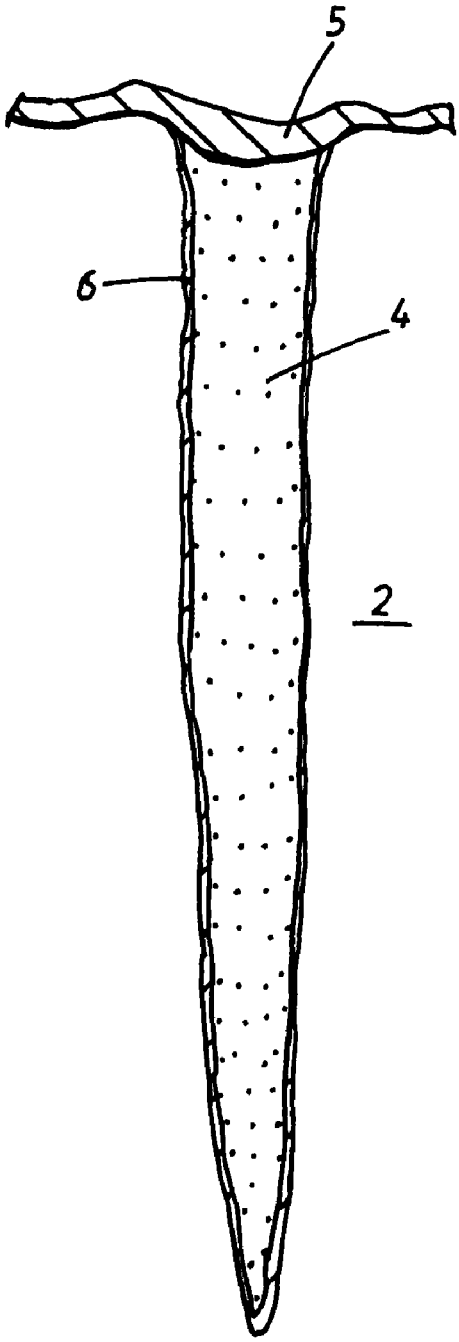

Further advantages and effects according to the invention will emerge from a study and consideration of the following, detailed description of the invention, including a number of its advantageous embodiments, from the patent claims and from the appended drawing figures, in which:

FIG. 1 shows a schematic cross section through a pyrotechnic priming charge comprising a coherent porous fuel structure filled with oxidizer, FIG. 2 shows a schematic cross section through a single pore according to FIG. 1, filled with oxidizer and lined with bonding agent.

DETAILED DESCRIPTION

In a preferred embodiment according to the invention, see FIGS. 1 and 2, the pyrotechnic priming charge 1 comprises a coherent porous fuel structure 2, preferably consisting of silicon (especially shown in FIG. 1 with the numeral 3), which fuel structure 2 is filled with an oxidizer 4, preferably a dinitramide salt, and a moisture inhibitor 5 applied to the surface of the primer 1.

The pyrotechnic priming charge 1 is produced by the said at least one oxidizer 4 being dissolved in an organic solvent, whereafter the solution with the oxidizer is fed to the porous fuel structure 2. After the solution has been absorbed in the porous fuel structure 2, the primer 1 undergoes a drying process in which the solvent is distilled off. The drying process is preferably realized by the supply of heat to the fuel structure 2 in the form of a warm air current. As a result of the drying process, the oxidizer 4 is precipitated as a fine crystalline layer within the pyrotechnic priming charge 1.

In order to increase the safety of the pyrotechnic priming charge 1 and prevent breakdown of the oxidizer 4, the said moisture inhibitor 5 is added in a closing operation after the addition of the oxidizer 4. The moisture inhibitor 5 prevents direct contact between the oxidizer 4 and the moisture and temperature of the ambient atmosphere. The moisture inhibitor 5 is added as a barrier to the surface of the primer 1 and comprises an elastomer or a wax, preferably an elastomer comprising polyisobutane. Where the moisture inhibitor 5 is constituted by an elastomer, it is supplied preferably as a prepolymer, which is subsequently polymerized. Following polymerization of the prepolymer, a thin elastic film with moisture-repelling properties is formed on the surface of the primer 1.

According to the invention, the stability and proofness of the pyrotechnic priming charge 1 against unintentional ignition can be further increased by the choice of oxidizer 4. Oxidizers 4 with high energy density which are stable and have low moisture sensitivity and which have proved particularly suitable in pyrotechnic priming charges 1 with porous fuel structures 2 according to the said type are constituted, for example, by dinitramide salts, especially dinitramide salts comprising ammonium dinitramide and tetraamine copper dinitramide.

Other dinitramide salts of interest comprise: tetrazole dinitramide, aminotetrazole dinitramide, ammonium furazan dinitramide, guanyl urea dinitramide, hexamine zinc dinitramide and tetraamine palladium dinitramide.

Solvents which have proved especially suitable in combination with ammonium dinitramide and tetraamine copper dinitramide comprise dimethyl formamide and/or tetrahydrofuran.

Other solvents are also of interest, but dimethyl formamide and tetrahydrofuran have demonstrated the best test results, above all regarding wettability in porous silicon structures 2. In order to speed up the distillation of solvent from the fuel structure 2, it has proved favourable to supply heat during the drying process according to a predetermined temperature programme. The degree of filling in the finished primer 1 can be affected by varying the quantity of oxidizer 4 in the solvent and/or by varying the number of admixtures of saturated oxidizer solution.

An alternative to the oxidizer 4 being added to the porous fuel structure 2 dissolved in a solvent is to heat the oxidizer 4 to its melting point and then add the oxidizer 4 as melt. One drawback is, however, that the number of dinitramides which can be used in the oxidizer 4 is limited, since not all dinitramides have a melting point, but instead disintegrate directly without melting. Further problems associated with the said process are that hot dinitramide reacts more easily upon contact with the fuel 2, which means an increased risk of unintentional ignition. The risk of unintentional ignition because of the oxidizer 4 being hot can be reduced, however, by first adding an isolating inhibitor to the porous fuel structure 2, so that direct contact between the oxidizer 4 and the fuel 2 is prevented.

In order further to improve the adhesion of the oxidizer 4 to the porous fuel structure 2, it has proved effective to use a bonding agent 6, see FIG. 2. The bonding agent 6 can be added either by being mixed directly with the oxidizer 4 or by the fuel structure 2 being supplied separately prior to the addition of the oxidizer 4. The use of bonding agent 6 means that the number of oxidizer solutions for filling the porous fuel structure 2 is reduced. The bonding agent 6 and the oxidizer 4 are mixed with a suitable solvent, such as dimethyl formamide and/or tetrahydrofuran. The process of mixing the oxidizer 4 and the bonding agent 6 is simple and means that the number of production steps is minimal. Alternatively, the bonding agent 6 can be supplied separately, in an extra operation, which bonding agent 6 forms a bonding agent layer between the oxidizer 4 and the fuel 2. The advantage is that the addition of the oxidizer 4 and the bonding agent 6 can be more easily monitored and that the thickness of the bonding agent layer can be controlled. Examples of suitable bonding agents 6 are polyglycidyl nitrate, polynitro aminomethyl methyloxetane, glycidyl azide polymer and polybisazidomethyloxetane.

The invention is not limited to the embodiments shown, but can be variously varied within the scope of the patent claims.

The invention claimed is:

1. Pyrotechnic priming charge comprising a coherent porous fuel structure and at least one oxidizer, wherein the pyrotechnic priming charge also comprises a moisture inhibitor for preventing breakdown of the oxidizer due to the influence of ambient moisture and temperature, and the moisture inhibitor comprises an elastomer, which elastomer is fed to the pyrotechnic priming charge as a prepolymer, which prepolymer, after hardening, has formed a thin elastic film with moisture-repelling properties.

2. Pyrotechnic priming charge according to claim 1, characterized in that the elastomer comprises polyisobutane.

3. Pyrotechnic priming charge according to claim 1, characterized in that the oxidizer comprises a dinitramide salt with low sensitivity to moisture and temperature variations.

4. Pyrotechnic priming charge according to claim 3, characterized in that the dinitramide salt comprises tetraamine copper dinitramide.

5. Pyrotechnic priming charge according to claim 3, characterized in that the dinitramide salt comprises ammonium dinitramide.

6. Pyrotechnic priming charge according to claim 1, characterized in that the pyrotechnic priming charge also comprises a bonding agent, which bonding agent comprises polyglycidyl nitrate.

* * * * *